United States Patent [19]

Arnold

[11] Patent Number: 4,860,937

[45] Date of Patent: Aug. 29, 1989

[54] DEVICE FOR DRIVING IN NAILS FOR HANGING PICTURES AND SIMILAR ARTICLES

[75] Inventor: Gerhard Arnold, Wiesbaden, Fed. Rep. of Germany

[73] Assignee: Friedhelm Pickhan, Siegen-Meiswinkel, Fed. Rep. of Germany

[21] Appl. No.: 176,132

[22] Filed: Mar. 31, 1988

[30] Foreign Application Priority Data

Mar. 31, 1988 [DE] Fed. Rep. of Germany ..... 3710774

[51] Int. Cl.[4] ..... B25C 1/02

[52] U.S. Cl. ..... 227/147; 227/120

[58] Field of Search ..... 227/120, 147, 149, 120, 227/121, 156

[56] References Cited

U.S. PATENT DOCUMENTS

| | | | |
|---|---|---|---|
| 975,310 | 11/1910 | Ybarrondo . | |
| 2,672,610 | 3/1954 | Colton . | |
| 2,963,706 | 12/1960 | Namanny | 227/147 X |
| 4,096,982 | 6/1978 | Stahl | 227/113 |
| 4,252,260 | 2/1981 | Burton | 227/149 X |
| 4,624,401 | 11/1986 | Gassner et al. | 227/120 X |

FOREIGN PATENT DOCUMENTS

| | | |
|---|---|---|
| 207636 | 2/1960 | Austria . |
| 380083 | 4/1986 | Austria . |
| 625383 | 7/1972 | Fed. Rep. of Germany . |
| 607684 | 7/1976 | Fed. Rep. of Germany . |
| 738635 | 4/1978 | Fed. Rep. of Germany . |
| 748862 | 5/1979 | Fed. Rep. of Germany . |
| 750562 | 5/1979 | Fed. Rep. of Germany . |
| 907644 | 9/1979 | Fed. Rep. of Germany . |
| 1526956 | 12/1966 | France . |

OTHER PUBLICATIONS

"Nagel mit Stufenkopf", Josef Pangerl, 11/29/62.
"Nagel", Otto Laux, 11/7/58.
"Rapid Dübler", Prospectus of Elektro-Feinmechanik Erich Holz.

*Primary Examiner*—Paul A. Bell
*Attorney, Agent, or Firm*—Wegner & Bretschneider

[57] ABSTRACT

A device (12) for driving in nails has a nail magazine (14), in which nails (1) each having a longitudinal cylinder body as nail head can be put on magazine, the nails being forced towards a driving-in channel (16). The nail (1) which is in the driving-in channel (16) can be driven into a wall by means of a ram (17) having a pusher (18). An indexing device (19, 20, 21) indexes audibly the ram (17) in the device (12) for driving in nails as soon as the nail (1) is completely driven into the wall.

8 Claims, 1 Drawing Sheet

DEVICE FOR DRIVING IN NAILS FOR HANGING PICTURES AND SIMILAR ARTICLES

BACKGROUND OF THE INVENTION

Figure 1:
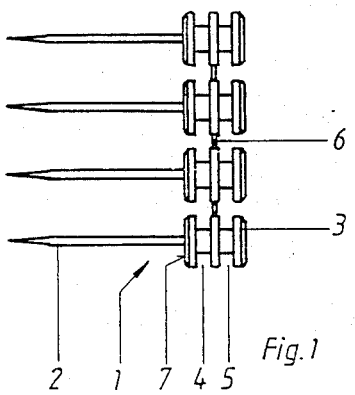

The invention relates to a device for driving nails into a wall, this device has a nail magazine in which the nails are stored, the nails being forced towards a driving-in channel, and with which device a ram is arranged in the driving-in channel, the ram being capable of moving axially towards the head of a nail that is positioned in the driving-in channel. Such devices are especially suited for driving in nails for hanging pictures.

When a nail for hanging a picture is to be driven into the wall, it is necessary to drive the nail into the wall only to a certain depth so that the loop of the picture can be put on the shaft behind the head. If suspension eyes with an elongated slot, which are typical for pictures without a frame, are used and the nail has not been driven into the wall far enough, the picture does not abut against the wall properly.

To drive in a nail sufficiently far enough by means of a hammer demands skill and much time, because usually the picture is to be hung for a trial and then the final depth of driving in is to be obtained by additional hammer blows. A nail which has been driven in too far is especially disadvantageous because for hanging the picture the nail is normally pulled back a little bit and after that it does not hold sufficiently.

The devices known to date for driving in nails for hanging pictures have been limited so the nails cannot be driven too far into the wall. This results in said device for driving in nails being unnecessarily complicated and thus expensive.

The object of the invention is to develop a device for driving in nails of the particular kind as mentioned at the beginning in such a manner that the nail can be driven into the wall with this device without special skill or excessive care to the correct depth for hanging a picture.

This object is achieved according to the invention because the nail magazine is formed being capable of taking in nails with an elongated cylinder body constituting the nail head, an abutting surface on the side of the shaft in order to limit the maximal depth of drive and a recess in the area of the cylindrical surface in order to hang a loop and because an indexing device is provided in the device for driving in nails in order to index audibly the ram in its final position thus completely driving in a nail.

Due to this indexing device, an audible clicking sound indicates that the nail has been driven completely into the wall with its head flush against the wall. Even if the sound was not heard, the nail cannot get too far into the wall because its head abuts against the wall, so that a stop in the device for driving in nails for limiting the maximum travel of the ram is not necessary. The indexing of the ram in its forward position prevents an additional nail from getting into the driving-in channel unintentionally. This results in the risk of an injury being reduced when the device for driving in nails is used improperly. When the ram is pulled back after a nail has been driven in, a clicking sound is heard caused by the jumping of a nail out of the magazine into the driving-in channel, indicating that the ram has been pulled back far enough.

When a nail has been driven completely into the wall, its recess in the nail head inevitably has the right distance from the wall in order to render it possible for common loops of pictures to be hung in it. When such a nail is used, the loop is not put on the shaft, as done when using common nails, but on the nail head.

Apart from the inevitable limitation of the depth of drive, an advantage of the use of such a nail is that the nail cannot break out of the wall with its abutting surface as easily as a common nail because it abuts against the wall. Therefore its shaft can be of a smaller diameter and shorter than a shaft of a common nail for the same weight. Therefore, the wall is less damaged and this damage is less or not noticed when the nail is removed.

The device for driving in nails has an especially simple design, the indexing device consisting of an indexing recess in the ram and a ball in the housing of the device for driving in nails, this ball being forced towards this recess by means of a spring.

Positioning the device for driving in nails on the wall is especially easy when according to another embodiment of the invention the driving-in channel is arranged in a housing section on the top side of the housing, this housing section protrudes in a semicircle on top of a straight-lined side of the abutting surface which, when driving in a nail, is put on the wall and when the longitudinal axis of the nail, to be driven in, is placed in the intersection point of the upper side of the abutting surface with the line running vertically through the top side of the semicircular housing section.

A mark that indicates three points of a crosshair is provided for the positioning when according to another embodiment of the invention, a mark, running in the longitudinal direction of the ram, is provided on the semicircular housing section.

The invention allows numerous embodiments. In order to show more clearly its basic principle, nails connected to form a chain for the device for driving in nails according to the invention, two examples for the hanging of a picture by means of such a nail and a device for driving in nails according to the invention are shown in the drawing and described below. The drawing shows in FIG. 1 a side view of a plurality of nails connected to form a chain which can be used in the device for driving in nails according to the invention, FIG. 2 a view on a common triangular loop, FIG. 3 a nail driven into the wall with a hung in triangular loop according to FIG. 2, FIG. 4 a view on a common suspension eye with an elongated slot for a picture without frame, FIG. 5 a nail driven into the wall with a hung in suspension eye with an elongated slot according to FIG. 4, FIG. 6 a schematic sectional view of a device for driving in nails according to the invention, FIG. 7 a front view of the device for driving in nails according to FIG. 6.

FIG. 1 shows a plurality of nails 1 connected to form a chain, the nails each consisting of a shaft 2 of hardened steel and a nail head 3 of thermoplastic synthetic material. Each nail head 3 is formed as an elongated cylinder body and has two recesses 4, 5 one behind the other each formed by grooves running all around on the area of the cylindrical surface. The individual nails 1 are connected at their nail heads 3 to form a chain by means of short, thin webs 6 in such a manner that they are aligned parallel to each other.

It is important to the device for driving in nails that the nail heads 3 each have on the side of the shaft 2 an abutting surface 7 which limits the depth of drive of the nail 1.

Figure 2:
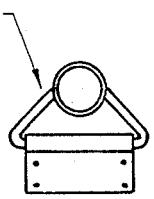
Figure 3:
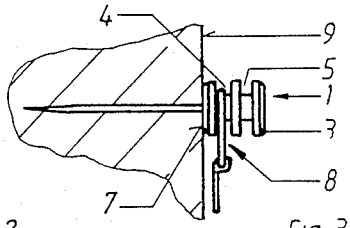

FIG. 2 shows a triangular loop 8 used for hanging pictures. FIG. 3 shows more clearly how this triangular loop 8 is hung in the recess 4 running all around the nail head 3 of a nail 1 driven into a wall 9. FIG. 3 shows that the nail 1 has been driven flush to the wall 9 with its abutting surface 7. Thereby, the nail head 3 braces against the wall 9 and thus prevents a break off. It is to be seen that the recess 5 remains unused. It can f.i. be used to fasten a line. For means of fastening, which are not placed very close to the wall, the recess 5 can be used instead of the recess 4.

Figure 4:
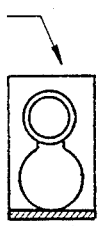
Figure 5:
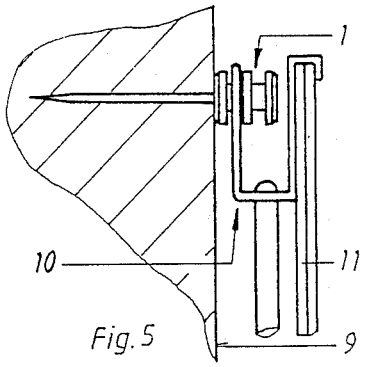

FIG. 4 shows a common suspension eye 10 with an elongated slot and FIG. 5 shows how this suspension eye 10 with an elongated slot can be fastened at the nail 1 driven into the wall 9. FIG. 5 also shows an upper area of a picture 11 without a frame.

Figure 6:
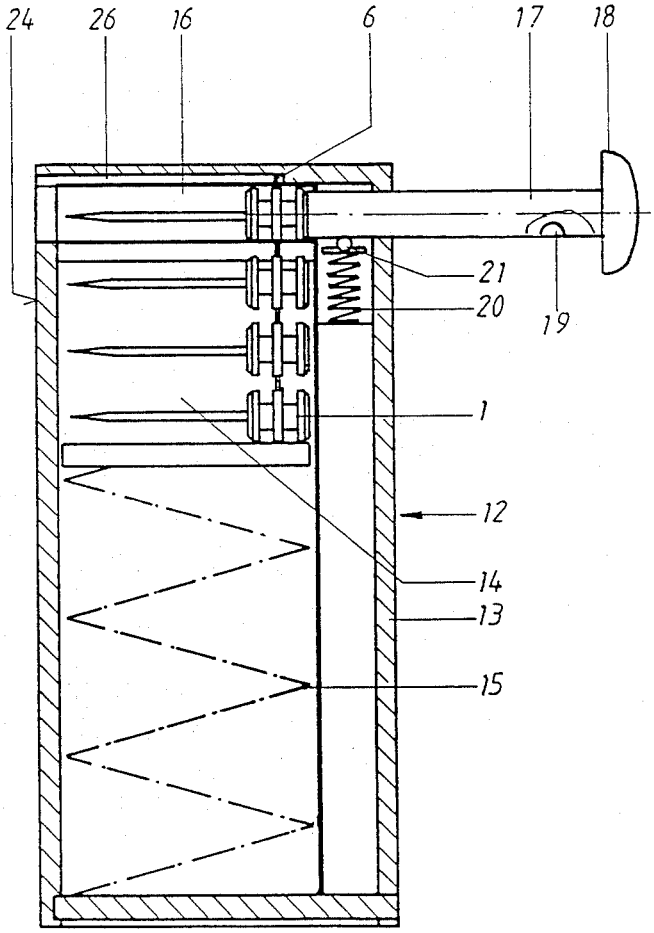
Figure 7:
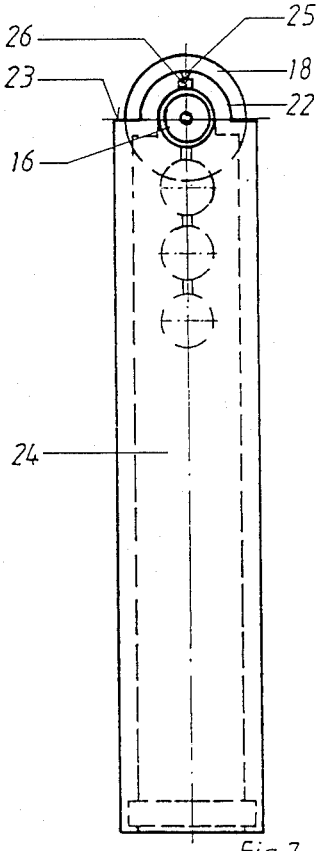

FIG. 6 shows a device 12 for driving in nails which has a nail magazine 14 in a housing 13. The nails 1 connected to form a chain are put into the nail magazine 14 and forced, by means of a compression spring 15, up to a driving-in channel 16 running at right angles to the nail magazine 14. Due to this arrangement, one nail **1*b* is in the driving-in channel 16. It can be carried out by means of a ram 17 which is arranged being capable of moving in the driving-in channel 16, the ram 17 for this purpose having a pusher 18 on which one pushes in order to drive in a nail. In the course of this, the connecting web 6 between the nail to be driven in and the next nail tears off. If the ram 17 is pulled back, it jumps into the driving-in channel 16**.

Furthermore, FIG. 6 shows that the ram 17 has an indexing recess 19, into which a ball 21 being forced by means of a spring 20 indexes when the ram 17 has completely driven the nail **1*b*** into the wall.

To drive a nail 1 into a wall 9, the device 12 for driving in nails is propped against the wall 9 with an abutting surface 24 which is to be seen in FIG. 6 at the left. The correct positioning of the device 12 for driving in nails is made easier by the fact that the housing section 22 protrudes in a semicircle a straightlined upper side 23, shown in FIG. 7, of the abutting surface 24 and that a mark 25 is provided on the top of the housing section 22. The point of the nail 1 is driven in at the place where the vertical line running through the mark 25 crosses the upper side 23.

As it is easily possible that a piece of the connecting web 6 remains standing upwards when a nail 1 has been torn off, it is advantageous to provide a longitudinal groove 26 formed like a trough in the driving-in channel 16 on its top side. The piece of the web can get into this longitudinal groove 26 so that the nail 1 can reliably get into the driving-in channel 16.

What is claimed is:

1. A device for driving nails into a wall, each of the nails having an elongated cylindrical nail head, the nail head having an abutment surface to which a shaft is connected so as to limit insertion of the nail into the wall and a recess for engaging a loop, said device comprising:

a nail magazine for storing a plurality of the nails;

a driving-in channel for receiving one of said plurality of the nails from the magazine;

means for forcing said plurality of the nails toward said driving-in channel;

a ram located in said driving-in channel and movable axially relative to the nail received in said driving-in channel so as to drive the nail into the wall; and indexing means for audibly indexing the ram when the ram is depressed to a point where the nail is completely driven into the wall.

2. The device as claimed in claim 1, further comprising a housing for receiving said nail magazine and said driving-in channel, wherein said indexing means comprises an indexing recess located in said ram, a ball located in said housing, and a spring for biasing the ball toward said indexing recess when the ram is depressed to said point.

3. The device as claimed in claim 1, further comprising a housing for receiving said nail magazine and said driving-in channel, said housing having a planar abutment surface which is placed against the wall, a planar upper surface, a housing section having an upper wall which extends in a semicircle above said upper surface, said driving-in channel being located in said housing section, wherein the nail received in the driving-in channel has a longitudinal axis located at the intersection of the upper surface and a vertical line running radially through the upper wall of the housing section.

4. The device as claimed in claim 3, further comprising a mark extending along a top portion of said upper wall parallel to a longitudinal axis of the ram.

5. A device for driving nails into a wall, comprising:

a nail magazine;

a plurality of nails located in said magazine, each of the nails having an elongated cylindrical nail head, the nail head having an abutment surface to which a shaft is connected so as to limit insertion of the nail into the wall and a recess for engaging a loop;

a driving-in channel for receiving one of said plurality of nails from the magazine;

means for forcing said plurality of nails toward said driving-in channel;

a ram located in said driving-in channel and movable axially relative to the nail received in said driving-in channel so as to drive the nail into the wall; and indexing means for audibly indexing the ram when the ram is depressed to a point where the nail is completely driven into the wall.

6. The device as claimed in claim 5, further comprising a housing for receiving said nail magazine and said driving-in channel, wherein said indexing means comprises an indexing recess located in said ram, a ball located in said housing, and a spring for biasing the ball toward said indexing recess when the ram is depressed to said point.

7. The device as claimed in claim 5, further comprising a housing for receiving said nail magazine and said driving-in channel, said housing having a planar abutment surface which is placed against the wall, a planar upper surface, a housing section having an upper wall which extends in a semicircle above said upper surface, said driving-in channel being located in said housing section, wherein the nail received in the driving-in channel has a longitudinal axis located at the intersection of the upper surface and a vertical line running radially through the upper wall of the housing section.

8. The device as claimed in claim 7, further comprising a mark extending along a top portion of said upper wall parallel to a longitudinal axis of the ram.

* * * * *